US006806228B2

(12) United States Patent
Sharma et al.

(10) Patent No.: US 6,806,228 B2
(45) Date of Patent: Oct. 19, 2004

(54) LOW TEMPERATURE SYNTHESIS OF SEMICONDUCTOR FIBERS

(75) Inventors: Shashank Sharma, Louisville, KY (US); Mahendra Kumar Sunkara, Louisville, KY (US)

(73) Assignee: University of Louisville, Louisville, KY (US)

( * ) Notice: Subject to any disclaimer, the term of this patent is extended or adjusted under 35 U.S.C. 154(b) by 250 days.

(21) Appl. No.: 09/896,834

(22) Filed: Jun. 29, 2001

(65) Prior Publication Data

US 2002/0076553 A1 Jun. 20, 2002

Related U.S. Application Data

(60) Provisional application No. 60/214,963, filed on Jun. 29, 2000.

(51) Int. Cl.[7] ..... B01J 21/04

(52) U.S. Cl. ..... 502/439; 502/263; 438/726

(58) Field of Search ..... 502/439, 263, 502/355; 438/726

(56) References Cited

U.S. PATENT DOCUMENTS

| | | | |
|---|---|---|---|
| 4,886,683 | A | 12/1989 | Hoke et al. |
| 5,334,296 | A | 8/1994 | Henkens et al. |
| 5,381,753 | A | 1/1995 | Okajima et al. |
| 5,725,674 | A | 3/1998 | Moustakas et al. |
| 5,858,862 | A | 1/1999 | Westwater et al. |
| 5,922,183 | A | 7/1999 | Rauh |
| 5,962,863 | A | 10/1999 | Russell et al. |
| 6,033,866 | A | 3/2000 | Guo et al. |
| 6,051,849 | A | 4/2000 | Davis et al. |
| 6,063,246 | A | 5/2000 | Wolfe et al. |

FOREIGN PATENT DOCUMENTS

| | | |
|---|---|---|
| JP | 2086121 | 3/1990 |
| JP | 11177134 | 7/1999 |

OTHER PUBLICATIONS

Publication No. WO026422A1 for "High Purity Gallium For Preparation of Compound Semiconductor, and Method and Apparatus for Purifying the Same" by Yamamura et al., published on May 11, 2000.

Publication No. WO9965068A1 for "Fabrication of Gallium Nitride Semiconductor Layers by Lateral Growth from Trench Sidewalls" by Zheleva et al., published on Dec. 16, 1999.

Publication No. WO9944224A1 for "Method of Fabricating Gallium Nitride Semiconductor Layers by Lateral Overgrowth Through Masks, and Gallium Nitride Semiconductor Structures Fabricated Thereby" by Davis et al., published on Sep. 2, 1999.

Y.F. Zhang, Y.H. Tang, N. Wang, C.S. Lee, I. Bello, S.T. Lee "One–Dimensional Growth Mechanism of Crystalline Silicon Nanowires", Journal of Crystal Growth 197 (1999) 136–140, no month.

J. Westwater, D.P. Gosain, S. Tomiya, S. Usui, and H. Ruda "Growth of Silicon Nanowires Via Gold/Silane Vapor–Liquid Solid Reaction", J. Vac. Sci. Technol. B 15(3), May/Jun. 1997, 554–557.

A.M. Morales and C.M. Lieber "A Laser Ablation Method for the Synthesis of Crystalline Semiconductor Nanowires", Science, vol. 279, Jan. 9, 1998, 208–211.

H.F. Yan, Y.J. Xing, Q.L. Hang, D.P. Yu, Y.P. Wang, J. Xu, Z.H. Xi, S.Q. Feng "Growth of Amorphous Silicon Nanowires Via a Solid–Liquid–Solid Mechanism", Chemical Physics Letters 323 (2000) 224–228, no date.

J.L. Gole and J.D. Stout, W.L. Rauch and Z.L. Wang "Direct Synthesis of Silicon Nanowires, Silica Nanospheres, and Wire–Like Nanosphere Agglomerates", Applied Physics Letters, vol. 76, No. 17, Apr. 24, 2000, 2346–2348.

J.D. Holmes, K.P. Johnston, R.C. Doty, B.A. Korgel "Control of Thickness and Orientation of Solution–Grown Silicon Nanowires", Science, vol. 287, Feb. 25, 2000, 1471–1473.

P. Scheier, J. Marsen, M. Lonfat, W. Schneider, K. Sattler "Growth of Silicon Nanostructures on Graphite", Surface Science 458 (2000, 113–122, no date.

D.P. Yu, Z.G. Bai, Y. Ding, Q.L. Hang, H.Z. Zhang, J.J. Wang, Y.H. Zou, W. Qian, G.C. Xiong, H.T. Zhou, and S.Q. Feng "Nanoscale Silicon Wires Synthesized Using Simple Physical Evaporation", Applied Physics Letters, vol. 72, No. 26, Jun. 29, 1998, 3458–3460.

Y.F. Zhang, Y.H. Tanh, N. Wang, D.P. Yu, C.S. Lee, I. Bello, and S.T. Lee "Silicon Nanowires Prepared by Laser Ablation at High Temperature", Applied Physics Letters, vol. 72, No. 15, Apr. 13, 1998, 1835–1837.

D.P. Yu, Y.J. Xing, Q.L. Hang, H.F. Yan, J. Xu, Z.H. Xi, S.Q. Feng "Controlled Growth of Oriented Amorphous Silicon Nanowires Via a Solid–Liquid–Solid (SLS) Mechanism", Physica E 9 (2001) 305–309, no date.

Lieber, "One–Dimensional Nanostructures: Chemistry, Physics & Applications", Solid State Communications, vol. 107, No. 11, 607–616, no date.

Sharma et al. "Novel Vapor–Liquid–Solid Synthesis Method for Carbon Nanostructures", presented on CD and at Carbon2001 Conference at The University of Kentucky, Lexington, KY in Jul. of 2001.

Zhang et al. "Morphology and Growth Mechanism Study of Self–Assembled Silicon Nanowires Synthesized by Thermal Evaporation", Chemical Physics Letters 337 (2001) 18–24, Mar. 30, 2001.

Wu et al. "Germanium Nanowire Growth Via Simple Vapor Transport", Chem. Mater. 2000, 12, 605–607, no month.

*Primary Examiner*—Stanley S. Silverman
*Assistant Examiner*—Edward M. Johnson
(74) *Attorney, Agent, or Firm*—Carrithers Law Office; David W. Carrithers

(57) ABSTRACT

A method of synthesizing semiconductor fibers by placement of gallium or indium metal on a desired substrate, placing the combination in a low pressure chamber at a vacuum from 100 mTorr to one atmosphere pressure in an atmosphere containing desired gaseous reactants, raising the temperature of the metal to a few degrees above its melting point by microwave excitation, whereby the reactants form fibers of the desired length.

2 Claims, 3 Drawing Sheets

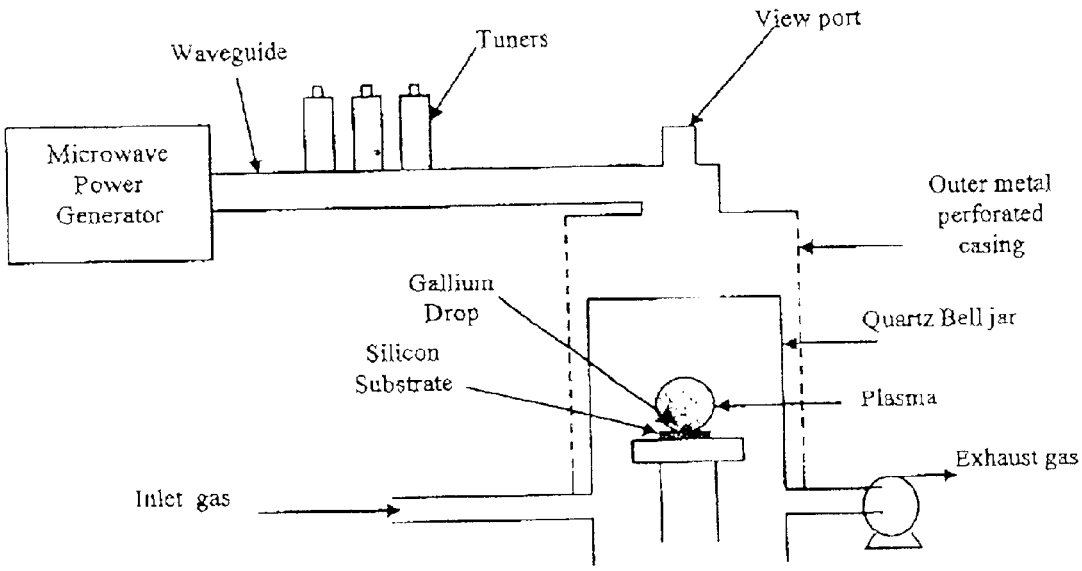
Figure 6. Experimental Setup.

LOW TEMPERATURE SYNTHESIS OF SEMICONDUCTOR FIBERS

This application claims priority from copending U.S. Provisional Application Ser. No. 60/214,963 filed on Jun. 29, 2000 which is hereby incorporated by reference herein.

This application is part of a government project. The research leading to this invention was supported by a Grant Number 9876251 from the National Science Foundation. The United States Government retains certain rights in this invention.

BACKGROUND OF THE INVENTION

1. Field of the Invention

The invention relates to the field of providing a synthesis technique to grow bulk quantities of semiconductor nanowires at temperatures less than 500° C.

2. Description of the Prior Art

One-dimensional semiconductor fibers are useful for many applications ranging from probe microscopy tips to interconnections in nanoelectronics. By "one-dimensional" it is meant that the fibers have extremely small diameters, approaching 40 Ångstroms. The fibers may be termed "nanowires" or "whiskers." Several methods are known for synthesis of these fibers. Included are VLS (vapor-liquid-solid) growth, laser ablation of silicon and silicon oxide species and combinations of these techniques.

In VLS growth, a liquid metal cluster or catalyst acts as the energetically favored site of absorption of gas-phase reactants. The cluster supersaturates and grows a one-dimensional structure of the material. A VLS method has been used to grow silicon nanowires by absorption of silane vapor on a gold metal surface. Variations of this methods have been used to produce other semiconductor fibers.

One variation is laser ablation. In this technique, the silicone species, such as $SiO_2$, is ablated to the vapor phase by laser excitation.

SUMMARY OF THE INVENTION

The present invention provides a method of synthesizing semiconductor fibers by placement of gallium or indium metal on a desired substrate, placing the combination in a low pressure chamber at a vacuum from 100 mTorr to one atmosphere pressure in an atmosphere containing desired gaseous reactants, raising the temperature of the metal to a few degrees above its melting point by microwave excitation, whereby the reactants form fibers of the desired length. When the metal is gallium, a temperature of about at least 50° C. is sufficient, preferably near 300° C. for best solubility and mobility within the melt. When the metal is indium, a temperature of about 200° C. is preferred. Preferably the substrate is silicon, most preferably silicon comprising an electronically useful pattern; the metal is gallium, the gaseous reactant is hydrogen, and the fibers formed comprise $SiH_x$. The gallium metal may be applied either in solid or droplet form or in the form of patterned droplets for patterning silicon microwires. Other forms of gallium droplet patterns may also include droplets in two dimensional and three dimensional channels for directed growth.

Another preferable substrate is germanium with hydrogen as gaseous reactant. The reactant hydrogen will form germane, $GeH_x$ in the gas phase which upon decomposition on a gallium substrate results in the deposition of germanium into gallium droplets. The dissolved germanium grows out as germanium nanowires.

Other semiconductors materials may be synthesized according to the methods of this invention. In each case, gallium or indium metal is used as the absorption sit-catalyst. Where the substrate is not readily vaporized to provide a gaseous reactant, a vapor substrate will be added to the reactive atmosphere. For example, GaAs substrates may be used, with a gallium drop and nitrogen in the gas phase, to grow GaN nanofibers.

These and other objects of the present invention will be more fully understood from the following description of the invention.

BRIEF DESCRIPTION OF THE DRAWINGS

A better understanding of the present invention will be had upon reference to the following description in conjunction with the accompanying drawings in which like numerals refer to like parts throughout the several views and wherein:

FIG. 6 is a schematic of the reaction chamber.

DESCRIPTION OF THE PREFERRED EMBODIMENT

This invention provides a novel synthesis route for growing one-dimensional structures of semiconductor materials in wire, whisker and rod shapes at temperatures well under 550° C., preferably less than 300° C. This low-temperature synthesis is made possible by the use of gallium as a catalytic absorption site. Gallium has a low melting temperature (~30° C.) and broad temperature range for the melt phase (30–2400° C. at 1 atm). Indium, which has a melting temperature of 156.6° C., and a melt range of 156.6 to 2000° C., is also useful as a catalyst. In one embodiment of the invention of the invention, growth of silicon fibers was observed when silicon substrates covered with a thin film of gallium were exposed to mixture of nitrogen and hydrogen in a microwave-generated plasma. The resulting silicon wires ranged from several microns to less than ten (10) nanometers in diameter. The observed growth rates were on the order of 100 microns/hour. Results indicate that this technique is capable of producing oriented rods and whiskers with reasonable size distributions. The growth mechanism in this method is hypothesized to be similar to that in other VLS process, i.e., rapid dissolution of silicon hydrides in gallium melt, which catalyzed subsequent precipitation of silicon in one dimension in the form of fibers.

This techniques offers several advantages over conventional VLS techniques using silicon-gold eutectic for catalyzed growth. When the fibers desired comprise silicon or germanium, there is no need to supply silicon or germanium in gaseous form. Secondly, the very low temperatures required when using gallium as the catalyst allows easier integration with other processing techniques and materials involved in electronics and opt-electronic device fabrication. Such nanometer scale one-dimensional semiconductor structure such as nanowires and nonwhiskers are expected to be critically important in advanced mesoscopic electronic and optical device applications.

The advantage of low-temperature fabrication are also useful for those semiconductors in which the substrate and the fibers differ in composition. In such case, both or all fibers components may be provided in the vapor phase.

To more explicitly teach the methods of this invention, the following detailed embodiments are provided for purposes of illustration only. Those skilled in the art may readily make substitutions and variations in substrates and reactants to synthesize other semiconductors on a gallium catalyst. Such substitutions and variations are considered to be within the spirit and scope of this invention.

EXAMPLE 1

Synthesis of $SiH_x$ Fibers

Figure 1:
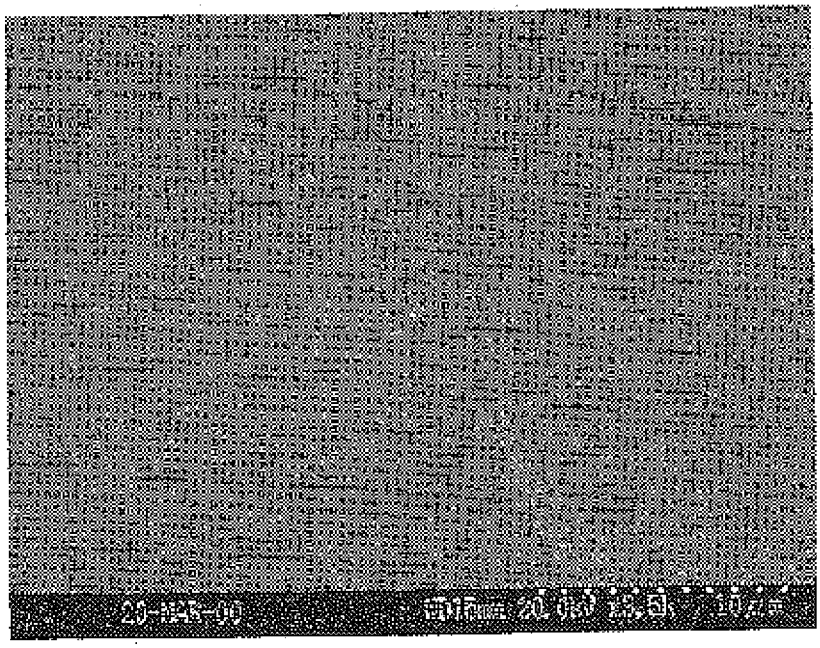
FIG. 1 shows fibers in the process of growth, each having a droplet of molten gallium on its tip.
Figure 2:
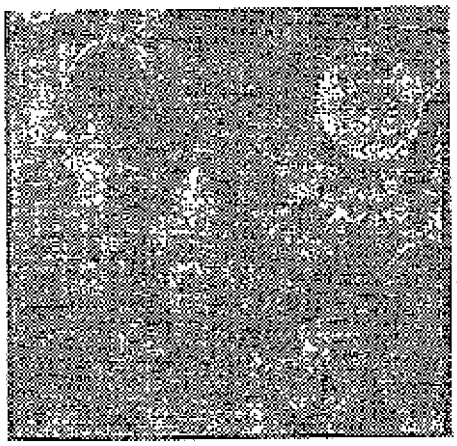
FIG. 2 is a scanning electron micrograph showing fibers in growth, with droplets of molten gallium
Figure 3:
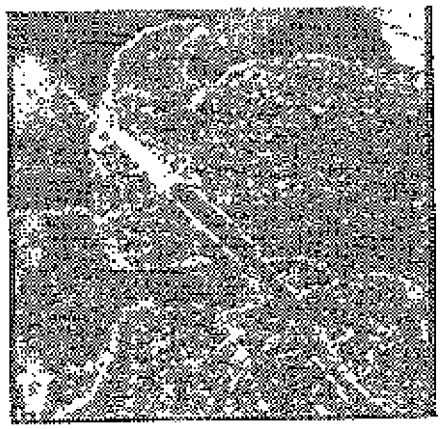
FIGS. 3 and 4 are scanning electron micrographs showing the range of fiber diameters obtained by practicing the methods of this invention.
Figure 4:
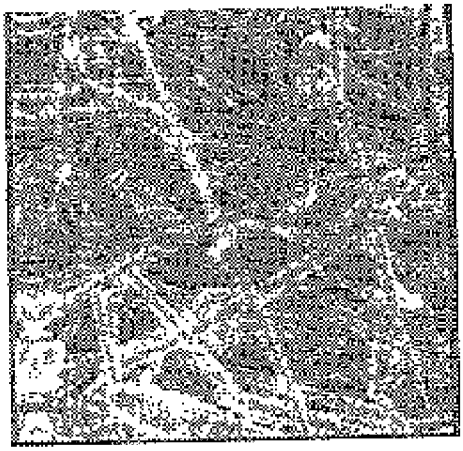
Figure 5:
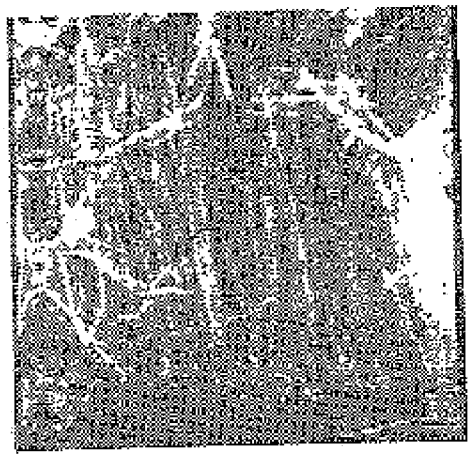
FIG. 5 is a transmission electron micrograph shows silicon nanowires with diameters <10 nanometers.

A silicon substrate (2 cm×2 cm) was prepared by cleaning with a 45% HF solution, thorough rinsing in acetone and ultra-sonication. Droplets of gallium metal at 70° C. were applied to form a film with a thickness of approximately 100 microns. A thermocouple was placed on the underside of the substrate to measure the temperature and the nitrogen flow rate was set to 100 sccm. The pressure in the reactor was set to 30 Torr. Microwaves at 2.45 Ghz were used to ionize the nitrogen gas. The input microwave power was 1000 W. The nitridation experiments were done in an ASTeX model 5010 bell jar reactor chamber equipped with an ASTeX model 2115 1500 W microwave power generator. Five sccm of hydrogen were introduced into the nitrogen plasma. The reaction was continued for six hours. Graphite blocks were used as substrate stage. The quartz bell jar volume was approximately 2000 cc. FIG. 6 shows a schematic of the reactor. The silicon substrate covered with an ashy structure was observed under a scanning electron microscope (SEM). FIGS. 1 through 5 show micrographs of varying thickness and length. FIG. 1 shows a group of nanowires, each with a tiny drop at the end. These fibers were grown with $H_2/N_2$ ratio of 0.05, pressure of 30 Torr and microwave power of 1000 W. FIG. 2 shows initial highly oriented growth of silicon nanofibers for short time scale growth (initial one hour). FIG. 3 shows a web of fibers grown for a longer time, five hours. Due to the long growth (initial one hour). FIG. 3 shows a web of fibers grown for a longer time, five hours. Due to the long growth duration, the grown wires were very long and intermingled. The limitation on size is time-dependant, but not process-dependant. FIG. 4 shows nanowires with different thicknesses. FIG. 5 shows a transmission electron micrograph of silicon nanowires with diameters in single digit nanometer scale. These fibers were grown with $H_2/N_2$ ratio of 0.0075, pressure of 50 Torr and 1000 W of microwave power. The elemental composition of the fibrous structures was determined using Energy Dispersive Spectroscopy (EDS).

EXAMPLE 2

Synthesize of Germanium Fibers

Germanium fibers can be grown using the above technique by using either germanium substrate or using germane in the vapor phase. The gas phase will preferably consist of hydrogen with or without nitrogen to result in the formation of germane, a gaseous source of germanium. German will be catalytically decomposed on the gallium substrate resulting in accelerated dissolution of germanium into the gallium melt.

EXAMPLE 3

Synthesis of Gallium Nitride Fibers

Nitrogen can also be dissolved into gallium melt, but at relatively higher temperatures than above, i.e., above ~600° C. At these temperatures, suing gallium droplets exposed to an atomic nitrogen source, such as plasma, one can achieve nitrogen saturated gallium melts. These nitrogen saturated gallium melts will form gallium nitride either in the whisker or nanowire format.

EXAMPLE 4

Synthesis of Silicon Nitride Fibers and Whiskers

Using a similar setup as that used for example 1, one can expose the gallium droplet to nitrogen and hydrogen plasma at relatively higher temperature, i.e., ~600° C., to achieve the dissolution of both nitrogen and silicon into the gallium droplet. The resulting silicon nitride whiskers or nanowires can be adjusted in diameter by varying the size of the gallium droplet.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented hereinabove. Rather, what is intended to be covered is within the spirit and scope of the appended claims.

We claim:

1. A process of synthesizing semiconductor fibers, the steps comprising: forming a catalytic metal on a substrate, placing the combination in a pressure chamber, adding gaseous reactant, applying sufficient microwave energy to raise the temperature in the chamber to a point above the melting point of the metal and continuing the process until fibers of the desired length are formed.

2. The process of claim 1, wherein the substrate is silicon, the catalytic metal is gallium or indium, and the gaseous reactant is hydrogen and the fibers are silicon.

* * * * *